US006406646B1

(12) United States Patent
Lee et al.

(10) Patent No.: US 6,406,646 B1
(45) Date of Patent: Jun. 18, 2002

(54) RESISTIVE PASTE FOR THE FORMATION OF ELECTRICALLY HEAT-GENERATING THICK FILM

(75) Inventors: Ki-Woong Lee, Kyungki-do; Jong-Hyun Park, Kangwon-do; Kyung-Won Chung, Kyungki-do, all of (KR)

(73) Assignee: Daejoo Fine Chemical Co., Ltd., Kyungki-Do (KR)

( * ) Notice: Subject to any disclaimer, the term of this patent is extended or adjusted under 35 U.S.C. 154(b) by 0 days.

(21) Appl. No.: 09/739,545

(22) Filed: Dec. 15, 2000

(30) Foreign Application Priority Data

Dec. 17, 1999 (KR) ..... 99-58533
Sep. 1, 2000 (KR) ..... 00-51585

(51) Int. Cl.[7] ..... H01B 1/08; H01B 1/16
(52) U.S. Cl. ..... 252/514; 252/520.3
(58) Field of Search ..... 252/514, 518.1, 252/520.3

(56) References Cited

U.S. PATENT DOCUMENTS 4,362,656 A * 12/1982 Hormadaly ..... 252/518
4,476,039 A * 10/1984 Hormadaly ..... 252/518
5,162,062 A * 11/1992 Carroll et al. ..... 148/24
5,510,823 A * 4/1996 Tanaka et al. ..... 346/141
5,900,295 A * 5/1999 Kawada ..... 428/36.9
6,174,462 B1 * 1/2001 Oka et al. ..... 252/514

* cited by examiner

*Primary Examiner*—Mark Kopec
(74) *Attorney, Agent, or Firm*—Katten Muchin Zavis Rosenman

(57) ABSTRACT

A resistive paste composition comprising 5 to 75% by weight of ruthenium(Ru) metal or ruthemium oxide particles having a specific surface area of 5 to 30 $m^2/g$, 5 to 75% by weight of silver(Ag) metal or its compound particles having an average particle size of 0.1 to 3 $\mu$m and a maximum particle size of 8 $\mu$m or less, 5 to 40% by weight of a glass frit having a softening point of 400 to 550° C. and 5 to 45% by weight of an organic binder can be coated by a conventional screen-printing or dipping method on a substrate and then calcined at a low temperature of about 500 to 600° C. to form an electrically heat-generating thick film layer having good stability, uniformity and heat-up characteristics.

11 Claims, No Drawings

RESISTIVE PASTE FOR THE FORMATION OF ELECTRICALLY HEAT-GENERATING THICK FILM

FIELD OF THE INVENTION

The present invention relates to a resistive paste composition for the formation of an electrically heat-generating thick film, particularly to a paste composition which can be calcined at about 600° C. or lower to provide a film having good stability, uniformity and heat-up characteristics.

BACKGROUND OF THE INVENTION

A resistive paste composition is used for forming a thick film resistive element on an electrically insulating substrate by a screen printing or dipping method, and it generally comprises conductive materials and inorganic and organic binder materials. The process for forming such a film involves a high temperature calcination step wherein the organic component is removed and the inorganic component is molten down to increase the integrity of the conductive components to the substrate, and hitherto, various resistive pastes have been developed.

For example, Japanese Unexamined Patent Publication No. sho 53-100496 discloses a paste for a resistor element, which comprises ruthenium oxide particles and glass frit powders dispersed in an organic medium composed of an organic solvent and a resin; and U.S. Pat. No. 5,510,823 assigned to Fuji Xerox Co., Ltd. describes a resistive element film-forming paste comprising an organic metal compound and at least one organic binder compound and an asphalt solution to improve the dispersion of the compounds. Further, Korean Patent No. 130831 issued to DuPont teaches a thick film resistor composition comprising 5 to 30 wt % of ruthenium pyrochlore oxide ($PbRuO_3$)and 10 to 90 wt % of a glass binder.

However, the process of preparing resistor elements using the paste compositions disclosed in the above patents requires a high calcination temperature ranging from about 600 to 1,000° C. Accordingly, their application is limited to substrates which can stand such a high temperature.

Recently, a method of preparing a film-type heat-generating element using a self-heating resistive paste composition has attracted attention since it requires no separate heating source and can reduce the weight of a device.

U.S. Pat. No. 5,900,295 assigned to Fuji Electric Co., Ltd. relates to a fixing roller used for fixing a toner on a paper sheet and installed on an electro-photographic devices such as a copying machine, a printer or a facsimile machine, which comprises a cylinder-shaped metallic base body, an insulation layer and a resistance layer. In this patent, the resistance layer is formed from a resin composition comprising a resin selected from polyphenylene sulfide, polyphthalamide and a liquid crystal polymer, and a mixture of carbon black and carbon fiber. However, the resistance layer must be formed by a cumbersome injection molding process due to the characteristics of the resin component used in this patent, and thus, it is difficult to provide a film having a uniform thickness and a good heat-generating property.

SUMMARY OF THE INVENTION

Accordingly, it is a primary object of the invention to provide an improved resistive paste composition which can be applied on a substrate by a printing method and can be calcined at a low temperature to form on the substrate a heat-generating thick film having good stability, uniformity and heat-up characteristics.

In accordance with an aspect of the present invention, there is provided a resistive paste composition for the formation of an electrically heat-generating layer, which comprises (a) 5 to 75% by weight of particles of ruthenium(Ru) metal or an oxide thereof having a specific surface area of 5 to 30 $m^2/g$, (b) 5 to 75% by weight of particles of silver(Ag) metal or a compound thereof having an average particle size of 0. 1 to 3 $\mu$m, the maximum particle size not exceeding 8 $\mu$m, (c) 5 to 40% by weight of a glass frit powder having a softening point of 400 to 550° C. and (d) 5 to 45% by weight of an organic binder.

DETAILED DESCRIPTION OF THE INVENTION

In the inventive composition, the conductive Ru and Ag components are employed to control the electrical and mechanical properties of the paste composition. Further, the glass frit is employed to increase the adhesive strength of the resulting thick film to the substrate, and the organic binder functions to enhance the dispersion of the conductive materials and the inorganic binder in the composition.

(a) Ru component

The Ru component employed in the present invention may be ruthenium metal or an oxide thereof, e.g., $RuO_2$, $GdBiRu_2O_{6-7}$, $Pb_2Ru_2O_{6-7}$, $Co_2Ru_2O_{6-7}$, $PbBiRu_2O_{6-7}$, $Cu_xBi_{2-x}Ru_2O_{6-7}$ ($0<x<1$) and $Bi_2Ru_2O_{6-7}$.

The Ru component in the form of particles has a specific surface area of 5 to 30 $m^2/g$, preferably 10 to 25 $m^2/g$, and an average particle diameter of 0.01 to 0.1 $\mu$m, preferably 0.02 to 0.08 $\mu$m. When the specific surface area is less than 5 $m^2/g$ or the average particle diameter is greater than 0.1 $\mu$m, the particle size is too great to provide a uniform film having smooth surface. Further, when the specific surface area is greater than 30 $m^2/g$ or the average diameter is less than 0.01 $\mu$m, the resulting paste composition has poor printing and calcining properties, leading to a film having a low density.

In the present invention, the particles of the Ru component are employed in an amount ranging from 5 to 75% by weight, preferably from 5 to 20% by weight of the composition. If the amount is greater than 75%, the surface smoothness of the film deteriorates, and if the amount is less than 5%, the film has an excessively high resistance.

(b) Ag component

The Ag component employed in the present invention may be metallic silver, or an oxide thereof (e.g., $Ag_2O$) or an alloy thereof (e.g., AgPd, $Ag_{0.1}Pd_{0.9}RhO_2$). In order to obtain a paste which can be calcined at a low temperature, it is particularly preferred to employ the Ag component in the form of plate-shaped particles.

The Ag component in the form of particles has preferably a specific surface area of 0.5 to 3.5 $m^2/g$ and an average particle diameter of 0.1 to 3 $\mu$m and a maximum particle size of 8 $\mu$m or less. When the specific surface area is less than 0.5 $m^2/g$ or the average particle diameter is greater than 3 $\mu$m, the resulting film has a rough surface and the resolution of the printed film pattern becones poor. Further, when the specific surface area is greater than 3.5 $m^2/g$ or the average particle diameter is less than 0.1 $\mu$m, the paste tends to agglomerate easily, has poor printability, and undergoes an excessive shrinkage during the calcination process, which leads to the formation of cracks on the film surface.

The Ag component preferably has a density of 2.5 to 6 $g/cm^3$. If the density is not within the specified range, the printability of the paste may become poor.

In the present invention, the particles of the Ag component are employed in an amount ranging from 5 to 75% by weight, preferably from 20 to 40% by weight of the composition. If the amount does not fall within the specified range, the film does not have a proper resistance.

(c) Glass frit

The glass frit employed in the present invention functions as an inorganic binder for bringing to the particles of the Ru component into contact with each other. Also, the glass frit powder which agglomerates during the calcination process enhances the adhesive strength of the resulting film to a substrate.

The glass frit used in the present invention has a softening point ranging from 400 to 550° C., preferably from 420 to 500° C. When the softening point is lower than 400° C., the resulting film tends to have blisters on the surface thereof due to inclusion of organic components. When the softening point is higher than 550° C., the adhesive strength of the resulting film to the substrate becomes poor.

In the present invention, the glass frit is employed in an amount ranging from 5 to 40% by weight, preferably from 10 to 40% by weight of the composition. If the amount is less than 5%, the adhesive strength of the calcined film to the substrate is poor, whereas if the amount is greater than 40%, the film's resistance becomes too high.

Examples of the glass frit which may be used in the present invention include a bismuth oxide($Bi_2O_3$)-based glass frit ("Glass Frit A"), a lead oxide (PbO)-based glass frit ("Glass Frit B"), or a mixture thereof. Specifically, Glass frit A preferably comprises at least 90% by weight of a glass frit having the composition represented in Table 1 and Glass frit B preferably comprises at least 90% by weight of a glass frit having the composition represented in Table 2. Further, the mixture form preferably comprises at least 90% by weight of a glass frit having the composition represented in Table 3.

TABLE 1

| Components | Content (wt %) |
|---|---|
| $Bi_2O_3$ | 40 to 90 (preferably 50 to 80) |
| $SiO_2$ | 5 to 30 (preferably 5 to 15) |
| $B_2O_3$ | 5 to 30 (preferably 7 to 20) |
| BaO | 2 to 40 (preferably 2 to 30) |

TABLE 2

| Components | Content (wt %) |
|---|---|
| PbO | 40 to 90 (preferably 50 to 80) |
| $SiO_2$ | 10 to 40 (preferably 10 to 30) |
| $B_2O_3$ | 5 to 30 (preferably 5 to 20) |
| $TiO_2$ | 0 to 10 (preferably 2 to 5) |
| $Al_2O_3$ | 0 to 20 (preferably 2 to 15) |

TABLE 3

| Components | Content (wt %) |
|---|---|
| $Bi_2O_3$ | 40 to 90 |
| PbO | 40 to 90 |
| $SiO_2$ | 5 to 30 |
| $B_2O_3$ | 5 to 30 |
| BaO | 2 to 40 |
| $TiO_2$ | 0 to 10 |
| $Al_2O_3$ | 0 to 20 |

As to the compositions of the above-mentioned glass frits, when the content of bismuth oxide or lead oxide is less than 40 wt %, the adhesive strength of the film does not enhance any longer, and when it is greater than 90 wt %, the softening point of the glass frit decreases and the adhesive strength deteriorates.

Further, when the content of silicon oxide is less than the lower limits specified in Tables 1, 2 and 3, the stability of the glass frit deteriorates, and when it is greater than the specified upper limits, it is difficult to calcine the paste at a temperature of 570° C. or lower.

Furthermore, in the above-mentioned glass frits, boron oxide, barium oxide, titanium oxide and aluminum oxide are employed to control the calcination temperature of the paste composition which is directly related to the adhesive strength of the film and the stability of the glass frit.

In accordance with the present invention, the glass frit in the form of a powder has an average particle size of 0.2 to 5 $\mu$m and a maximum particle size of 10 $\mu$m or less. When the average diameter is within the specified range, a film having a satisfactory adhesive strength, low resistance and high density can be obtained by a low temperature calcination procedure.

(d) Organic binder

Examples of the organic binder which may be employed in the present invention include celluloses such as ethyl cellulose, methyl cellulose, nitrocellulose and carboxymethyl cellulose; and resins such as acrylic acid esters, methacrylic acid esters, polyvinyl alcohols and polyvinyl butyrals. An acryl resin and ethyl cellulose may be preferably employed.

In the present invention, the organic binder is employed in an amount of 5 to 45% by weight.

(e) Organic solvent

In the inventive paste composition, an organic solvent may be used for the purpose of dissolving the organic binder and dispersing the conductive particles and glass frit powder to obtain the paste composition having a suitable viscosity. Representative examples of the organic solvent include texanol(2,2,4-trimethyl- 1,3-pentanediolmonoisobutyrate), ethylene glycol (terpene), butyl carbitol, ethyl cellosolve, ethyl benzene, isopropyl benzene, methylethyl ketone, dioxane, acetone, cyclohexanone, cyclopentanone, isobutyl alcohol, dimethyl sulfoxide, terepineol, pine oil, polyvinyl butyral, 3-methoxybutyl acetate, y-butyrolactone, diethyl phthalate and a mixture thereof.

(f) Other additives

In addition to the above-mentioned components, the inventive paste composition may optionally comprise other additives in order to enhance the storage stability of the paste composition, the uniformity of the film thickness and the resolution of the printed pattern, and also to prevent the formation of cracks on the film surface. Representative examples of such additives include a polymerization stopping agent(e.g., monomethyl ether), a dispersant(e.g., polyacrylates, cellulose derivatives), a tackifying agent(e.g., a silane coupling agent), a defoaming agent, a plasticizer (e.g., polyethylene glycol, dibutyl phthalate), a surfactant and a thixotropic agent.

The additives may be employed in amounts that would not adversely affect the intended functions of the above-mentioned main components.

(g) Compounding and Formation of heat-generating layer

The inventive paste composition may be compounded with a conventional compounding equipment, for example, using a three-screw roller, roll mill, mixer or homogenizer.

For imparting the morphology suitable for applying on a substrate, the inventive composition is controlled to have a viscosity of 70,000 to 300,0000 cp (centipoise), preferably 100,000 to 200,0000 cp, more preferably 130,000 to 180, 0000 cp at a shear rate of 4 $S^{-1}$.

In accordance with the present invention, a heat-generating thick film layer having good chemical and physical stability may be formed by coating the inventive paste composition on a suitable substrate by using a convenient screen printing or dipping method, drying the coated substrate at a temperature ranging from 80 to 120° C. for about 5 to 10 minutes, and calcining the dried substrate at a relatively low temperature ranging from 500 to 600° C. for about 5 to 30 minutes. The temperature may be elevated to the calcination temperature at a rate of 30 to 80° C./min, preferably about 40° C./min.

The inventive heat-generating thick film has a low resistance ranging from about 0.1 to 30 $\Omega/mm^2$ and an operating temperature ranging from room temperature to 300° C., and can be heated-up quickly to about 200° C. (i.e., a temperature conventionally required for operating various electric or electronic equipments) in about 5 to 15 seconds. Therefore, the inventive heat-generating thick layer may be beneficially employed in various electronic and electrical equipments comprising a heat-generating means, e.g., a thermal head.

The following Examples are given for the purpose of illustration only and are not intended to limit the scope of the invention.

EXAMPLE 1

A powder mixture was prepared as represented in Table 4.

TABLE 4

| Components | Amounts (parts by weight) |
|---|---|
| Particles of $Pb_2Ru_2O_{6-7}$ having an average diameter of 0.05 $\mu$m and a specific surface area of 10 $m^2/g$ | 10 |
| Particles of $RuO_2$ having an average diameter of 0.03 $\mu$m and a specific surface area of 23 $m^2/g$ | 13 |
| Ag particles having an average diameter of 1 $\mu$m and a maximum particle size of 3 $\mu$m | 20 |
| Glass Frit A* particles having an average diameter of 1 $\mu$m and a maximum particle size of 3.6 $\mu$m | 30 |

*Glass Frit A: $Bi_2O_3$ 68.9 wt %, $SiO_2$ 10.0 wt %, $B_2O_3$ 11.8 wt %, BaO 6.5 wt % and $Al_2O_3$ 2.8 wt %, a softening point of 460° C. and a thermal expansion coefficient of $90 \times 10^{-7}$/K Then, 92 parts by weight of the powder mixture and 8 parts by weight of ethyl cellulose were added to terepineol, the viscosity of the resulting mixture was adjusted to about 150,000 cp, and then, compounded using a three screw roller, to obtain a resistive paste composition.

The paste composition was screen-printed on a substrate made of 96% alumina and dried at 150° C. for 10 minutes to obtain a 2.5 cm×2.5 cm resistive film having a thickness of 23 $\mu$m. The resistive film was heated to 550° C. at a rate of 40° C./min and maintain at 550° C. for 20 minutes to form a resistive layer a thickness of 6 $\mu$m on the substrate.

On the both end of the resistive layer thus obtained, electrode layers having a thickness of 10 $\mu$m were formed by a conventional method, and then, in order to protect the electrode layers, a protective glass layer was formed using a glass composition comprising 70 wt % of a glass frit consisted of 85 wt % of PbO, 5 wt % of $SiO_2$ and 10 wt % of $B_2O_3$ (a softening point of 305° C., an average particle size of less then about 3 $\mu$m and a maximul particle size of about 10 $\mu$m or less) and 30 wt % of an organic vehicle, to prepare a thick film heat-generating element.

The thick film heat-generating element thus obtained was found to have a resistance of 12 $\Omega/mm^2$, and to require 12 seconds for it to reach 200° C. when AC 110 V was applied to the electrodes.

EXAMPLE 2

The procedure of Example 1 was repeated except for using a powder mixture having the composition shown in Table 5.

TABLE 5

| Components | Amounts (parts by weight) |
|---|---|
| Particles of $Pb_2Ru_2O_{6-7}$ having an average diameter of 0.05 $\mu$m and a specific surface area of 10 $m^2/g$ | 10 |
| Particles of $RuO_2$ having an average diameter of 0.03 $\mu$m and a specific surface area of 23 $m^2/g$ | 13 |
| Plate-shaped Ag particles having an average diameter of 3 $\mu$m and a maximum particle size of 8 $\mu$m | 20 |
| Glass Frit A* particles having an average diameter of 1 $\mu$m and a maximum particle size of 3.6 $\mu$m | 30 |

*Glass Frit A: $Bi_2O_3$ 68.9 wt %, $SiO_2$ 10.0 wt %, $B_2O_3$ 11.8 wt %, BaO 6.5 wt % and $Al_2O_3$ 2.8 wt %, a softening point of 460° C. and a thermal expansion coefficient of $90 \times 10^{-7}$/K The resistive thick film had a thickness of 5 $\mu$m and the heat-generating element was found to have a resistance of 6 $\Omega/mm^2$, and to require 6 seconds for it to reach 200° C. when AC 110 V was applied to the electrodes.

EXAMPLE 3

The procedure of Example 2 was repeated except for using a powder mixture having the composition shown in Table 6.

TABLE 6

| Components | Amounts (parts by weight) |
|---|---|
| Particles of $Pb_2Ru_2O_{6-7}$ having an average diameter of 0.05 $\mu$m and a specific surface area of 8 $m^2/g$ | 10 |
| Particles of $RuO_2$ having an average diameter of 0.03 $\mu$m and a specific surface area of 23 $m^2/g$ | 13 |
| Plate-shaped Ag particles having an average diameter of 3 $\mu$m and a maximum particle size of 8 $\mu$m | 20 |
| Glass Frit B** particles having an average diameter of 1 $\mu$m and a maximum particle size of 3.6 $\mu$m | 30 |

**Glass Frit B: PbO 72 wt %, $SiO_2$ 5 wt %, $B_2O_3$ 10 wt %, $TiO_2$ 3 wt % and $Al_2O_3$ 10 wt %, a softening point of 460° C. and a thermal expansion coefficient of $90 \times 10^{-7}$/K The resistive thick film had a thickness of 5 $\mu$m and the heat-generating element was found to have a resistance of 25 $\Omega/mm^2$, and to require 12 seconds for it to reach 200° C. when AC 220 V was applied to the electrodes.

Comparative Example 1

The procedure of Example 1 was repeated except for using a powder mixture having the composition shown in Table 7.

TABLE 7

| Components | Amounts (parts by weight) |
|---|---|
| Particles of $Pb_2Ru_2O_{6-7}$ having an average diameter of 0.05 $\mu$m and a specific surface area of 8 $m^2/g$ | 0 |
| Particles of $RuO_2$ having an average diameter of 0.03 | 0 |

TABLE 7-continued

| Components | Amounts (parts by weight) |
|---|---|
| μm and a specific surface area of 23 $m^2/g$ | |
| Ag particles having an average diameter of 1 μm and a maximum particle size of 3 μm | 40 |
| Glass Frit A* particles having an average diameter of 1 μm and a maximum particle size of 3.6 μm | 33 |

*Glass Frit A: $Bi_2O_3$ 68.9 wt %, $SiO_2$ 10.0 wt %, $B_2O_3$ 11.8 wt %, BaO 6.5 wt % and $Al_2O_3$ 2.8 wt %, a softening point of 460° C. and a thermal expansion coefficient of $90 \times 10^{-7}$/K The resistive thick film had a thickness of 4 μm and the heat-generating element was found to have a resistance of 480 Ω/$mm^2$, and to break down when AC 110 V was applied to the electrodes.

Comparative Example 2

The procedure of Example 3 was repeated except for using a powder mixture having the composition shown in Table 8.

TABLE 8

| Components | Amounts (parts by weight) |
|---|---|
| Particles of $Pb_2Ru_2O_{6-7}$ having an average diameter of 0.8 μm and a specific surface area of 2 $m^2/g$ | 10 |
| Particles of $RuO_2$ having an average diameter of 0.5 μm and a specific surface area of 4 $m^2/g$ | 13 |
| Plate-shaped Ag particles having an average diameter of 3 μm and a maximum particle size of 8 μm | 20 |
| Glass Frit B** particles having an average diameter of 1 μm and a maximum particle size of 3.6 μm | 33 |

**Glass Frit B: PbO 72 wt %, $SiO_2$ 5 wt %, $B_2O_3$ 10 wt %, $TiO_2$ 3 wt % and $Al_2O_3$ 10 wt %, a softening point of 460° C. and a thermal expansion coefficient of $90 \times 10^{-7}$/K The resistive thick film had a thickness of 8 μm and the heat-generating element was found to have a resistance of 25 kΩ/$mm^2$, and to require 10 minutes and 30 seconds for it to reach 200° C. when AC 110 V was applied to the electrodes.

Comparative Example 3

The procedure of Example 1 was repeated except for using a powder mixture having the composition shown in Table 9.

TABLE 9

| Components | Amounts (parts by weight) |
|---|---|
| Particles of $Pb_2Ru_2O_{6-7}$ having an average diameter of 0.05 μm and a specific surface area of 8 $m^2/g$ | 10 |
| Particles of $RuO_2$ having an average diameter of 0.03 μm and a specific surface area of 23 $m^2/g$ | 13 |
| Ag particles having an average diameter of 1 μm and a maximum particle size of 3 μm | 20 |
| Glass Frit C*** particles having an average diameter of 1 μm and a maximum particle size of 3.6 μm | 30 |

***Glass Frit C: PbO 53 wt %, $SiO_2$ 15 wt %, $B_2O_3$ 10 wt % and $Al_2O_3$ 27 wt %, a softening point of 580° C. and a thermal expansion coefficient of $69 \times 10^{-7}$/K The resistive thick film had a thickness of 8 μm and the heat-generating element was found to have a resistance of 4.3 kΩ/$mm^2$, and to require 5 minutes and 15 seconds for it to reach 200° C. when AC 110 V was applied to the electrodes. Further, the thick film was broken so that the calcined film cannot be obtained.

While the invention has been described in connection with the above specific embodiments, it should be recognized that various modifications and changes may be made to the invention by those skilled in the art without departing from the scope of the invention as defined by the appended claims.

What is claimed is:

1. A resistive paste composition for the formation of an electrically heat-generating layer, which comprises (a) 5 to 75% by weight of particles of ruthenium(Ru) metal or an oxide thereof having a specific surface area of 5 to 30 $m^2/g$, (b) 5 to 75% by weight of particles of silver(Ag) metal or a compound thereof having an average particle size of 0.1 to 3 μm; the maximum particle size not exceeding 7 μm, (c) 5 to 40% by weight of a glass frit powder having a softening point of 400 to 550° C. and (d) 5 to 45% by weight of an organic binder, the glass frit comprising 40 to 90 wt % of $Bi_2O_3$, 5 to 30 wt % of $SiO_2$, 5 to 30 wt % of $B_2O_3$, and 2 to 40 wt % of BaO.

2. The resistive paste composition of claim 1, wherein the oxide of ruthenium is selected from the group consisting of $RuO_2$, $GdBiRu_2O_{6-7}$, $Pb_2Ru_2O_{6-7}$, $Co_2Ru_2O_{6-7}$, $PbBiRu_2O_{6-7}$, $Cu_xBi_{2-x}Ru_2O_{6-7}$ ($0<x<1$), $Bi_2RuO_{6-7}$ and a mixture thereof.

3. The resistive paste composition of claim 1, wherein the Ru component (a) has an average particle size of 0.01 to 0.1 μm.

4. The resistive paste composition of claim 1, wherein the Ag component (b) is in the form of plate-shaped particles.

5. The resistive paste composition of claim 1, wherein the Ag component (b) has a specific surface area of 0.5 to 3.5 $m^2/g$.

6. The resistive paste composition of claim 1, wherein the glass frit further comprises 40 to 90 wt % of PbO, 0 to 10 wt % of $TiO_2$ and 0 to 20 wt % of $Al_2O_3$.

7. The resistive paste composition of claim 1, wherein the glass frit has an average particle size of 0.2 to 5 μm, the maximum particle size not exceeding 10 μm.

8. A heat-generating thick film layer deposited on an insulating substrate which is obtained by coating the resistive paste composition of claim 1 and calcining the coated layer at a temperature ranging from 500 to 600° C.

9. The heat-generating film of claim 8, which has a low resistance of about 0.1 to 30 Ω/$mm^2$.

10. The heat-generating film of claim 8, which reaches 200° C. in 5 to 15 seconds.

11. The heat-generating film of claim 8, wherein the substrate is selected from the group consisting of stainless steel, ceramics and glass.

* * * * *